United States Patent [19]

Shimizu

[11] Patent Number: 4,574,563

[45] Date of Patent: Mar. 11, 1986

[54] METHOD AND APPARATUS FOR PRODUCING PHOTOGRAPHIC FILM

[75] Inventor: Shigehisa Shimizu, Kanagawa, Japan

[73] Assignee: Fuji Photo Film Co., Ltd., Kanagawa, Japan

[21] Appl. No.: 573,128

[22] Filed: Jan. 23, 1984

[30] Foreign Application Priority Data

Jan. 22, 1983 [JP] Japan ..... 58-9160

[51] Int. Cl.[4] ..... B65B 25/14

[52] U.S. Cl. ..... 53/430; 53/118; 83/367; 83/423; 493/28; 493/365

[58] Field of Search ..... 53/430, 116, 118, 520; 83/367, 345, 423; 493/365, 364, 10, 28, 8

[56] References Cited

U.S. PATENT DOCUMENTS

| | | | |
|---|---|---|---|
| 2,940,232 | 6/1960 | Wallace et al. | 53/116 |
| 2,969,724 | 1/1961 | Lemche | 83/423 X |
| 3,140,572 | 7/1964 | Petersen et al. | 53/520 X |
| 3,172,322 | 3/1965 | Hirschey | 83/423 X |
| 3,499,202 | 3/1970 | Napor et al. | 53/430 X |
| 3,751,874 | 8/1973 | Schultes et al. | 53/520 X |
| 3,933,069 | 1/1976 | Tall et al. | 83/367 X |

FOREIGN PATENT DOCUMENTS

| | | |
|---|---|---|
| 52-115215 | 9/1977 | Japan . |
| 57-177137 | 10/1982 | Japan . |

*Primary Examiner*—James F. Coan

*Attorney, Agent, or Firm*—Young & Thompson

[57] ABSTRACT

A method and apparatus for continuously producing photographic film, comprises perforating film strip, applying characters to the perforated film strip as latent images, and cutting it into sized film strips. The photographic film strip withdrawn from a roll of film is perforated along its longitudinal margins and then provided with characters as latent images such as frame numbers, symbols and the like. After the provision of characters, the photographic film strip is cut into sized film strips which are thereafter wound into containers. The film moves continuously lengthwise from the time it is withdrawn from the supply roll, to the time it is rewound in the containers as sized film strips. In this way, the cost of equipment and labor is reduced.

15 Claims, 5 Drawing Figures

METHOD AND APPARATUS FOR PRODUCING PHOTOGRAPHIC FILM

BACKGROUND OF THE INVENTION

The present invention relates to a method and apparatus for continuously producing photographic film by perforating the film, applying characters thereto and cutting it.

In the manufacture of 16 mm and 35 mm roll films, the automatic continuous production of film to obtain predetermined lengths of film strip has found widespread acceptance because it contributes to savings in time and labor. As a rule, the process comprises the steps of producing a film web by providing photosensitive emulsion layers on the surface of a flexible, transparent base or film support which is a long, wide web, slitting the film web into narrow film strips, perforating the narrow film strips, applying latent images of characters to the perforated film strips, cutting the perforated film strip into predetermined lengths of film strip which are relatively short, winding each film strip into a container for protection against light, and packaging the containers each including a film strip for shipping, as is more fully disclosed in U.S. Pat. No. 2,940,232 and Japanese patent unexamined publication No. 115,215/77.

In the step of providing photosensitive emulsion layers on the surface of a web-like film support, the film web with photosensitive emulsion layers coated thereon is wound in a roll after drying. The film web in a roll is slit into narrow film strips, while it is rewound and then wound again in rolls. The slit film strip is rewound for perforating along the longitudinal margins thereof, and subsequently characters are applied, for instance frame numbers, symbols, marks and the like (which are herein generically referred to as "characters") as latent images which are later photographically developed during the processing of the exposed film. After the provision of perforations and characters the film strip is again wound in a roll in preparation for the following steps. In the cutting and winding steps, the film web is cut into sized film strips and then put into containers. The containers are then packed in boxes for shipping.

The above film-producing method, however, is disadvantageous in that not only is it difficult to provide a simplified process of film production, but also a large capital investment is required and a reduced rate of production is suffered, because separate machines are used for each step of the process. As a rule, it is necessary in the conventional process to provide the film strip with cutting marks in the step wherein it is provided with characters, which marks are scanned later for cutting the film strip in order to form sized film strips. Furthermore, as the length to which the film web is cut is determined in the step wherein the film strip is provided with characters, it is unavoidable to classify rolled film strips in accordance with the lengths to which they are to be cut if it is desired continuously to manufacture different sizes of film strips. These disadvantages make process control troublesome and the process unsuitable for a diversified small-quantity production line.

There has recently been proposed a photographic film production method which provides a unified step for slitting, perforating and character application, wherein a long strip of photographic film is perforated, provided with characters as latent images, and slit and then rolled, as is fully disclosed in Japanese patent unexamined publication No. 177,137/82. This method is advantageous in order to simplify the process of film production. On the other hand, it has the disadvantages that it is difficult to change the size of film strip to be produced and that it is very difficult to cut the film strip accurately to a predetermined length, because there are no cutting marks.

OBJECTS OF THE INVENTION

It is therefore a principal object of the present invention to provide a method and apparatus for producing photographic film strips wherein the steps of perforating a long web of film, applying characters to the perforated film as latent images and cutting it into sized film strips are unified into a continuous process without the provision of steps for rolling up the film between successive steps.

It is another object of the present invention to provide a method and apparatus for producing photographic film strips which is improved so as to provide various sizes of photographic film from a rolled film and is suitable for a diversified small-quantity production of photographic film strips.

It is a further object of the present invention to provide a method and apparatus for producing photographic film strips wherein photographic film strips are cut to size following the application of characters thereto, the cutting of photographic film strips being independent of any cutting marks.

It is a still further object of the present invention to provide a method and apparatus for producing photographic film strips wherein the application of characters to and the cutting of photographic film strips are controllably performed in correspondence with the moved length of film strip as determined from the number of perforations thereof.

SUMMARY OF THE INVENTION

In accordance with the invention, for accomplishing the above-mentioned and other objects and features, a roll of film strip is advanced to be perforated along its longitudinal margins, is supplied with characters, and is cut to size, in a continuous operation. Th character applying and cutting operations are controllably performed in accordance with the moved length of film strip which is determined from the number of perforations provided immediately previously.

The continuous operations of perforating, applying characters, and cutting, enable the film strip to be cut precisely to a predetermined length without applying cutting marks to the marginal portion.

In accordance with the present invention, the method and apparatus cannot only provide a simplified process of film production, but also minimize the cost of equipment owing to a unified step of applying characters to films and cutting them into film strips. Furthermore, the method and apparatus require only a reduced number of operations of rolling up film strip so as to prevent the film strip from getting scratch marks, and this results in an improvement in productivity. Additionally, as the size of film to which the film strip is to be cut can be changed at any time during production, process control becomes easy and a diversified small-quantity production of different sizes of film strips is facilitated.

Other objects and advantages of the invention will become apparent from the following description taken in conjunction with the accompanying drawings.

BRIEF DESCRIPTION OF THE DRAWINGS

In the detailed description of the preferred embodiments of the invention presented below, reference is made to the accompanying drawings, in which.

DETAILED DESCRIPTION OF THE INVENTION

Figure 1:
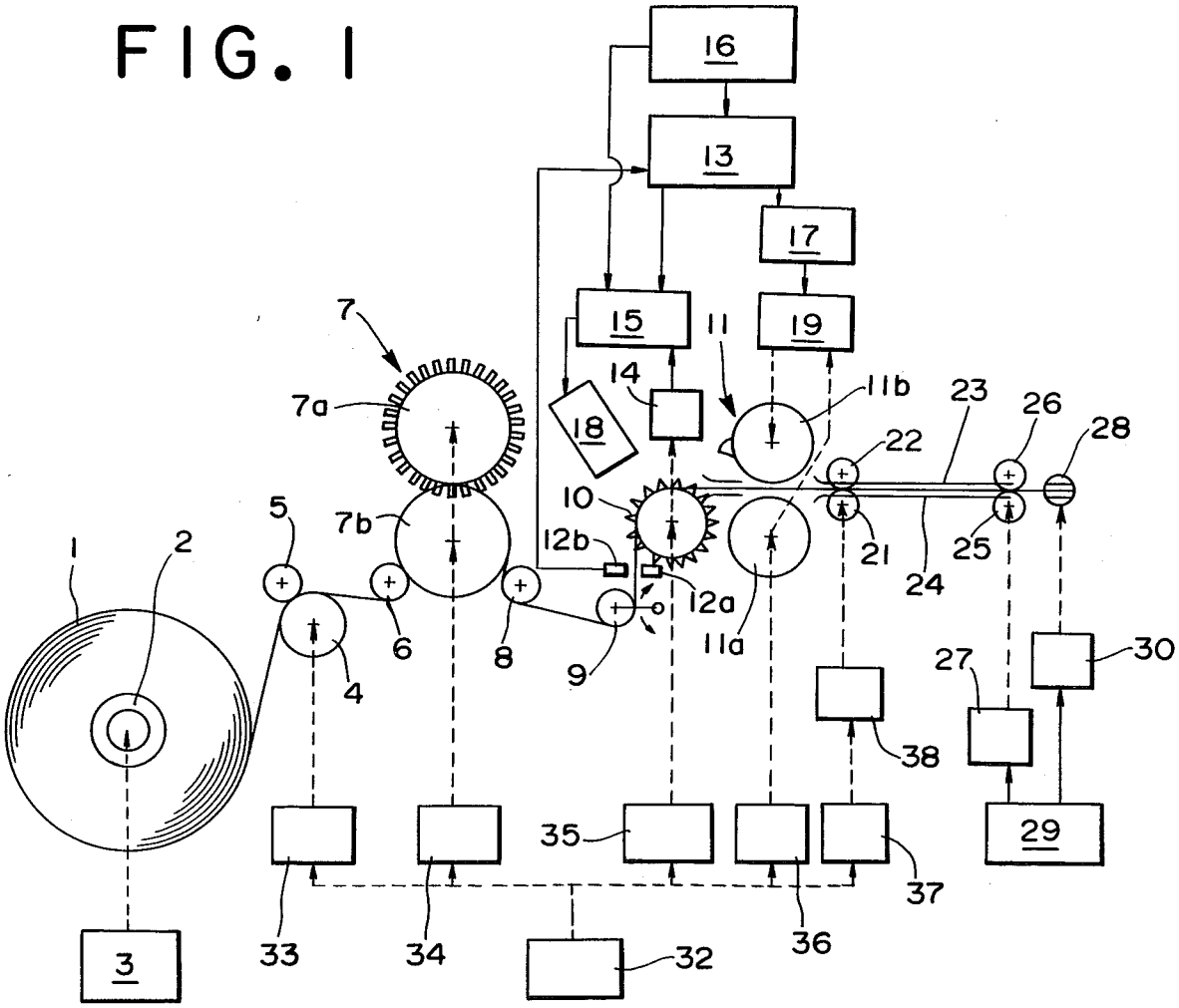
FIG. 1 is a diagrammatic view of one embodiment of apparatus in accordance with the present invention.

Referring now to the drawings in greater detail, wherein like numerals denote like parts, there is shown somewhat diagrammatically in FIG. 1, producing apparatus embodying the present invention. A strip of photosensitive film 1 is illustrated as extending from some convenient supply roll coiled on core 2. Th core 2 is rotated by a drive mechanism 3 associated therewith to supply the film strip 1. To advance the film strip 1 from the supply, there are provided a pair of driving rollers 4 and 5 adapted to frictionally engage the film strip 1 between them. The driving rollers 4 and 5 are adapted to rotate at the same peripheral speed to withdraw the film strip 1 from the supply at a uniform speed to avoid the application of sudden stresses thereto.

The film strip 1 advances about an idler roller 6 toward a rotary perforator arrangement 7 for forming perforations along the longitudinal marginal portions thereof during the continuous advance thereof. As shown in FIG. 1, the rotary perforator arrangement 7 comprises a punch-drum and die-drum. To further advance the film strip 1 with perforations formed by the rotary perforator arrangement 7, to a cutting step, there is provided a sprocket roller 10 adapted to engage the film strip 1 through the perforations. The sprocket roller 10 is adapted to rotate at the same peripheral speed to advance the film strip 1 to a trim-cutting arrangement 11. In order to maintain tension on the film strip 1 as it is advanced between the perforator arrangement 7 and the trim-cutting arrangement 11, there are provided an idler roller 8, and a tension roller 9 mounted on a spring-loaded pivotal arm.

As a means for detecting perforations, there is provided a photographic detector comprising light-emitting and light-receiving members 12*a* and 12*b*, respectively, positioned adjacent the sprocket roller 10, the output pulse signals from the light receiving member 12*b* being fed to a synchronizing controller 13.

In accordance with the present invention, a position detector 14 such as a pulse generator is directly associated with the sprocket roller 10 so as to generate pulse signals one for every detection of the predetermined length of film strip, which signal is fed to a controller 15 for the application of characters to the film strip.

The synchronizing controller 13 is adapted to count pulse signals from the light-receiving member 12*b* to provide start signals which, in turn, are fed to and actuate controllers 15 and 17 for applying characters to the film strip and for cutting the film strip with characters applied, respectively, in conformity with information from a means 16 for setting film size which is set prior to the operation of the apparatus.

For applying characters to the film strip, there is provided a printer arrangement 18 which may be of the type more fully disclosed in Japanese Utility Model No. 16,589/81, Japanese Patent unexamined Publications Nos. 42037/82 and 163226/82 and Japanese Utility Model unexamined Publication No. 38341/81. The controller 15, to which the information as to characters to be applied to the film strips is supplied from the film size setting means 16, causes the arrangement 18 to print the characters such as letters and symbols on the film strip at proper positions in response to pulse signals from the position detector 14 upon the receipt of a start signal from the synchronizing controller 13.

The cutting controller 17 causes single-revolution clutch means 19 to be turned one full revolution each time a start signal is received from the synchronizing controller 13 so as to allow the severing arrangement 11 to cut the film strip to a predetermined length. The severing arrangement 11 may comprise a pair of rotatable knives 11*a* and 11*b* located on opposite sides of the film. As the upper knife 11*b* is operationally associated with the single rotation clutch means 19, it is always stopped at a fixed position for another cutting operation.

The trimly cut film strips are advanced by means of a pair of feed rollers 21 and 22 and pass between another pair of feed rollers 25 and 26 after passing through a passageway defined by upper and lower guide members 23 and 24.

The feed rollers 25 and 26 are adapted to be driven by driving means 27 which may be of a well-known type so as to force the film strip to travel forwardly, causing the film strip at its leading end to reach and then enter the slotted opening formed in the spool shaft of a film container.

The operation of the driving means 27 and hence feed rollers 25 and 26 is commenced when the driving means 30 receives a signal from a winding controller 29 when the spool shaft 28 is located in its film-receiving position. Upon engaging the leading end in the slotted opening of the spool shaft, a driving means 30 is actuated to rotate the spool shaft 28, winding up the film strip therearound. To ensure the winding of the film strip around the spool shaft, there is provided means for sensing the orientation of the spool shaft 28 in the appropriate position and in that case emitting a signal which, in turn, operates to cause the winding controller 29 to provide a winding signal with a predetermined delay.

In accordance with the present invention, a main motor 32 is provided to drive the aforementioned driving roller 4, the rotary perforator arrangement 7, the sprocket roller 10 and the trim-cutting device 11 through reduction gears 33 to 36, respectively. It should be noted that the rollers are adapted to rotate at the same peripheral speed to advance the film strip at a uniform speed to avoid the application of sudden stress thereto, and that the rotational motion of the main motor 32 is transferred to the feed rollers 21 and 22 through a reduction gear 37 and a hysteresis clutch 38.

In the operation of the apparatus described above, the information as to film size (exposure number such as 20, 36 etc.) and film sensitivity is entered into the synchronizing controller 13 and the printing controller 15, respectively, through the setting means 16 prior to the operation of the apparatus.

In order to initiate the operation of the apparatus, the main motor 32 is actuated to rotate the respective rollers at the same time the drive mechanism is actuated to withdraw the film strip 1 from the supply. Upon reaching the perforator arrangement 7, the film strip 1 is provided with perforations at regular intervals along its longitudinal marginal portions while being continuously advanced. After the perforating operation, the perforation detecting means 12 detects the perforations 1*a* (see FIG. 2) of the film strip and emits signals, one for every perforation, which, in turn, are fed to and counted by the synchronizing controller 13 for determining the moved length of the film strip by the number of the counted pulses.

As described hereinbefore, the synchronizing controller 13 provides start signals for cutting and printing, respectively, in conformity with the film size information from the setting means 16. The printing controller 15, upon receiving the start signal, emits signals that cause the printer 18 to emit light, thereby forming light images in conformity with the printing information, to which images the film strip 1 is exposed, consonant with the pulse signals from the position detector 14, so as to apply the latent images of characters such as frame numbers and the like.

Figure 2:
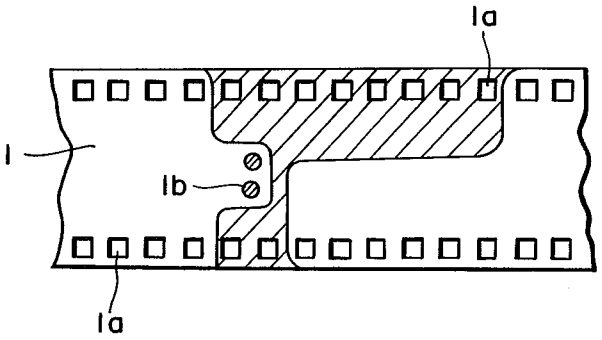
FIG. 2 is a fragmentary plan view of a film strip which can be trimly subdivided in two.

At the cutting station adjacent the printing station, the film strip 1 with the latent images of characters applied thereto, is then trimly cut by the trim-cutting arrangement 11 upon receipt of the start signal, in such a way that the location of the characters is maintained in unchanged relationship relative to the end of the film strip 1. In the trim-cutting operation, the boundary between neighboring film strips 1 shaded in FIG. 2 is severed and the leading end portion is simultaneously provided with holes for engagement with the spool shaft 28. The trimly cut film strip 1 is further advanced by feed rollers 21, 22, 25 and 26 to engage the spool shaft through the holes 1B provided in the leading end thereof so as to be wound around the spool shaft 28.

Figure 3:
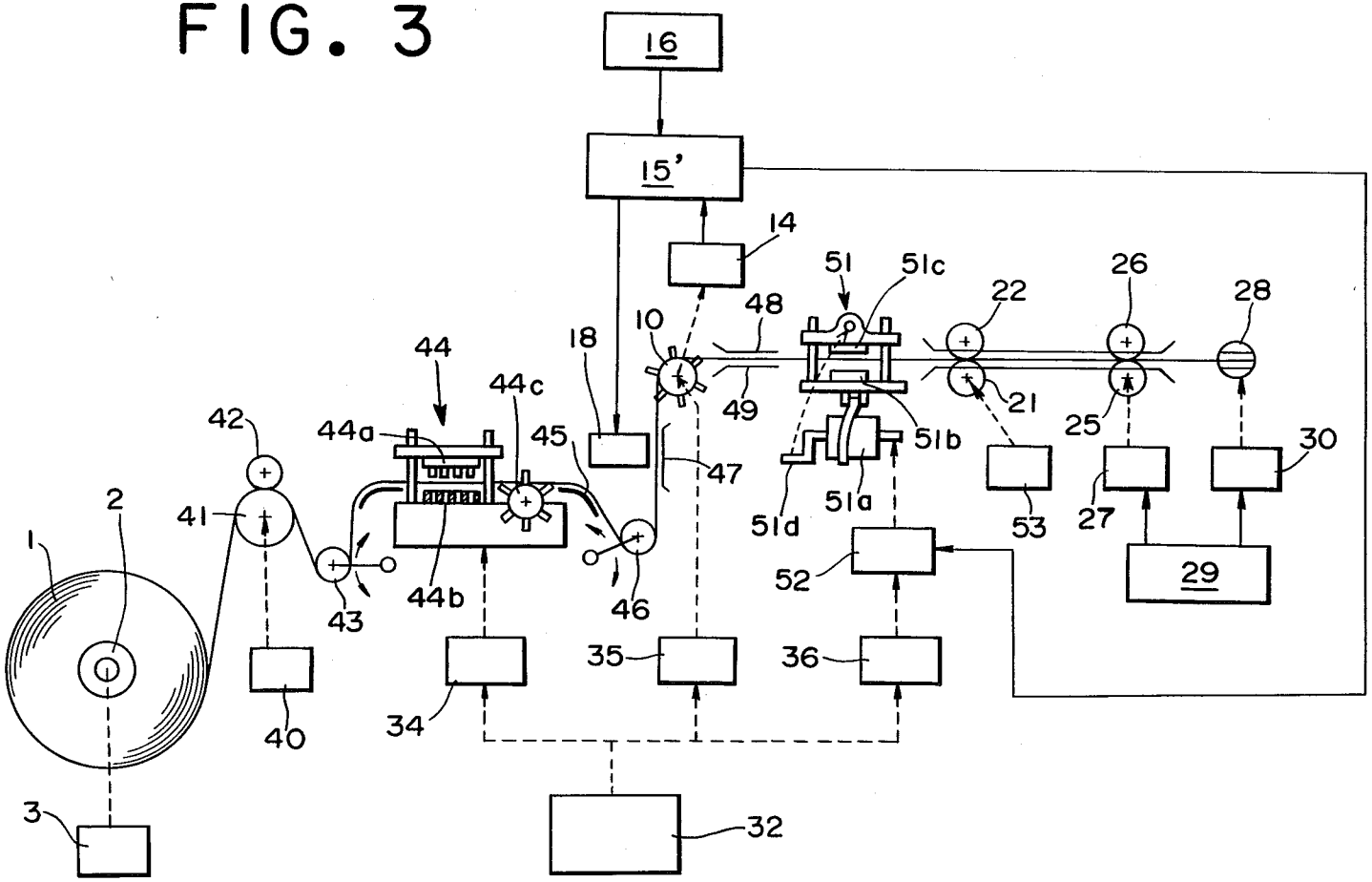
FIG. 3 is a diagrammatic view of another embodiment of apparatus in accordance with the present invention.

In FIG. 3, there is shown somewhat diagrammatically a modified form of apparatus embodying the present invention. A film strip 1 is withdrawn from the supply by a pair of feed rollers 41 and 42 rotatably associated with a driving means 40, to be advanced toward a perforator arrangement 44 of the type having an intermittent motion. In accordance with this embodiment, there is provided a tension roller 43 mounted on a springloaded pivotal arm shown between the rollers 41, 42 and the perforator arrangement 44, for avoiding the application of sudden tension to the film strip 1. In the form shown, the perforator arrangement 44 comprises a punch member 44*a* movable up and down, a stationary die member 44*b* and an intermittently rotatable sprocket 44*c*. The punch member 44*a* is adapted to move down so as to perforate the film strip along the longitudinal marginal portions when the rotational motion of the sprocket 44*c* is interrupted. A conventional Geneva movement and cam member are provided between the perforator arrangement 44 and reduction gear 34 to intermittently operate the arrangement 44.

The perforated film strip 1 is continuously advanced through guide means 45 and around another tension roller 46 mounted on a spring-loaded pivotal arm, thereafter reaching a sprocket 10 engageable with the film strip through the perforations. As a means for detecting the position of film strip, there is provided a pulse generator 14 directly associated with the sprocket 10.

The apparatus includes control means 15' for applying characters to film strips, which means are adapted to receive and count pulse signals from the position detector 14. Every time the count of pulse signals reaches the set count with reference to the film size information from the setting means 16, the control means 15' provides a signal which, in turn, causes the printer 18 to commence the application of characters to the film strip 1. At this time, the control means 15' supplies the printing information to the printer 18 concerning the film position detected. As a means for locating the film strip in the desired position, there is provided a fixed support member 47.

The film strip 1 with characters applied at the printing station is further advanced through guide members 48 and 49 in its path, reaching a trim-cutting device 51 of a well known oscillatory mode of operation for trimly cutting the film strip to size. The trim-cutting device 51 comprises a stationary and movable knife 51*b* and 51*c* which, in turn, are adapted to move in unison along the path of advancement of the film strip in synchronism with the advance of the film strip. To cause transverse motion of the trim-cutting device 51, there is provided a rotatable camming mechanism 51*a*. On the other hand, the movable knife 51*c* is adapted to move up and down, cooperating with the stationary knive 51*b* to cut pieces of material from the film strip 1 so as to make sure that the boundary between neighboring strips is removed in its entirety.

The up and down motion of the movable knife 51*c* which is in synchronism with the advancement of the film strip 1, is caused by a crank mechanism 51*d*. It is to be noted that the camming mechanism 51*a*, which is operationally associated with a well-known type of single-revolution clutch means 52, is caused to rotate one full revolution when the control means 15' for counting perforations emits a start signal, and thereafter to stop at a fixed position for the performance of the subsequent trim-cutting. The start signal is emitted upon the counting of a predetermined number of perforations which is chosen as a function of the distance between the printing station and the trim-cutting station. The film strip 1 is then advanced by the feed rollers 21 and 22 which are driven by another drive means 53 and is wound around the spool shaft 28 as a result of the rotational motion of the feed rollers 25 and 26 and the spool shaft 28 itself.

Figure 5:
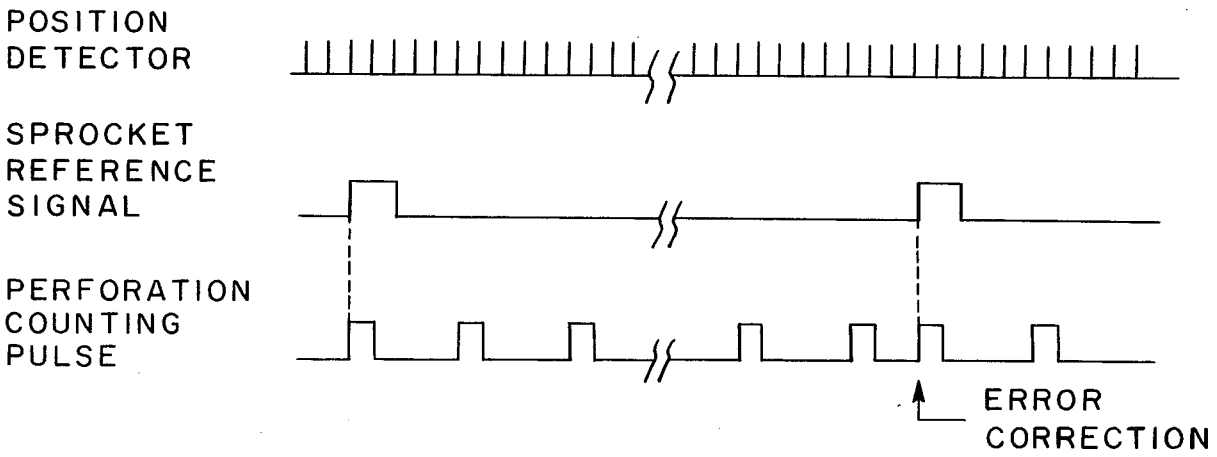
FIG. 5 is a wave-form chart showing the wave-forms of signals from elements of the counter arrangement of FIG. 4.
Figure 4:
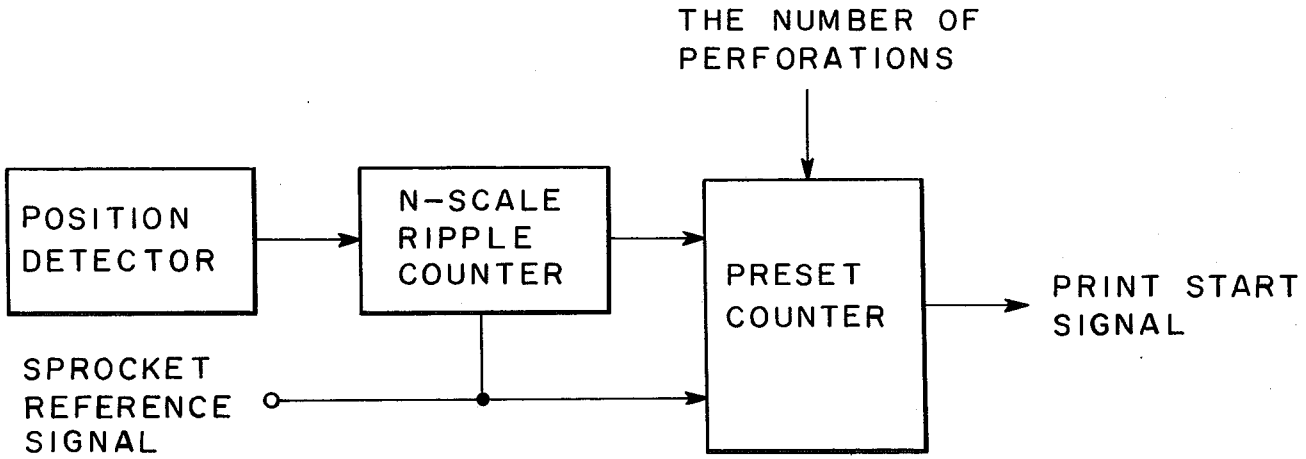
FIG. 4 is a block diagram of a counter arrangement for counting the of perforations.

FIG. 4 shows a circuit for counting the number of perforations according to pulses from the position detector 14; and FIG. 5 shows a wave-form chart of signals from the circuit of FIG. 4. Signals from the position detector 14 are supplied to an N-scale ripple counter 55 which is adapted to emit a perforation count signal upon counting N pulses corresponding to the distance between two successive perforations. The perforation count signal causes the preset counter 56 to advance the count by "1" (one). The preset counter 56 is adapted to emit a start signal for printing when the count thereof reaches a preset number of perforations defined according to the desired film size.

For the prevention of errors of the position detector in operation, the sprocket 10 is provided with a light-blocking member which moves past photosensing means once each revolution so as to produce a sprocket reference signal which, in turn, operates to reset both the N-scale ripple 55 and the preset counter 56. As a result of the resetting of these counters, the operational error of the sprocket 10 that may occur during a revolution can be corrected.

What is claimed is:

1. In a method for producing photographic film strips, comprising the steps of withdrawing a photographic film strip from a supply thereof, perforating the withdrawn photographic film strip, applying characters to said photographic film strip as latent images, and then cutting said film strip into sized film strips; the improvement comprising the steps of:

selecting a length of strip to be cut, detecting the advanced length of said photographic film strip, emitting a signal responsive to the detection of said advanced length, and controlling the steps of character application and cutting responsive to said signal.

2. A method as defined in claim 1, wherein the steps of character applying and cutting are repeated for each said sized film strip advanced.

3. A method as defined in claim 1, wherein said detecting step is performed by counting perforations.

4. A method as defined in claim 1, further comprising the step of winding said sized film strip into a container with a leader portion left outside said container.

5. A method as defined in claim 1, in which said withdrawing is effected by unrolling from a roll of film strip, the withdrawn strip moving continuously lengthwise until said winding into a container.

6. In an apparatus for producing photographic film strip comprising means for withdrawing a photographic film strip from a supply thereof, means for perforating said withdrawn photographic film strip, means for applying characters as latent images to said photographic film strip, and means for cutting said photographic film strip; the improvement comprising:

means for selecting the length of strip to be cut, means for detecting the advanced length of said photographic film strip with perforations and for emitting a signal, and means responsive to said signal for controlling the operation of said character applying means and said cutting means.

7. An apparatus as defined in claim 6, wherein said detecting means is adpated to count said perforations.

8. An apparatus as defined in claim 6, further comprising means for winding each said photographic film strip into a container with a leader portion left outside said container.

9. An apparatus as defined in claim 8, further comprising means moving continuously lengthwise the withdrawn film strip until said winding into a container.

10. An apparatus as defined in claim 7, wherein said detecting means comprises a light-emitting device and a light-receiving device which are disposed in confronting relation on opposite sides of the path of said perforations so as to detect perforations passing therebetween.

11. An apparatus as defined in claim 6, wherein said detecting means comprises a sprocket roller adapted to engage perforations of said photographic film strip, a position detector associated with said sprocket roller and a ripple counter for counting pulse signals emitted by said position detector.

12. An apparatus as defined in claim 6, wherein said perforating means comprises a rotary perforator which comprises a punch drum and a die drum coating with said punch drum.

13. An apparatus as defined in claim 6, wherein said cutting means comprises a rotary cutter.

14. An apparatus as defined in claim 6, wherein said perforating means comprises an intermittent perforator which comprises a stationary die member and a punch member movable toward and away from said stationary die member.

15. An apparatus as defined in claim 6, wherein said cutting means is a reciprocating cutter movable transversely of the film strip in synchronism with the advance of the photographic film strip and comprising a coating movable knife and stationary knife.

* * * * *